US006547385B2

(12) United States Patent
Nakajima

(10) Patent No.: US 6,547,385 B2
(45) Date of Patent: Apr. 15, 2003

(54) RE-TRANSFERABLE INK JET IMAGE FORMING METHOD AND AN IMAGE FORMING SHEET THEREOF

(75) Inventor: Atsushi Nakajima, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/163,802

(22) Filed: Jun. 5, 2002

(65) Prior Publication Data

US 2003/0035038 A1 Feb. 20, 2003

(30) Foreign Application Priority Data

Jun. 14, 2001 (JP) ..... 2001-179968

(51) Int. Cl.[7] ..... B41J 2/01
(52) U.S. Cl. ..... 347/103
(58) Field of Search ..... 347/103, 120, 347/123, 111, 159, 141, 155, 127, 128, 17, 154, 61; 399/271, 290, 292, 293, 294, 33, 67, 320

(56) References Cited

U.S. PATENT DOCUMENTS 6,357,871 B1 * 3/2002 Ashida et al. ..... 347/106

* cited by examiner

*Primary Examiner*—Raquel Yvette Gordon
(74) *Attorney, Agent, or Firm*—Cameron Kerrigan Squire Sanders & Dempsey, L.L.P.

(57) ABSTRACT

An image forming method, comprising the steps of:

jetting at least one of a plurality of different color inks for each pixel onto an image forming sheet by a plurality of ink-jet heads to form an image on the image forming sheet, the jetting step including a step of regulating a total amount of the plurality of different color inks for each pixel to form a mixed color image to be at most 250% of a predetermined maximum amount of one of the plurality of different color inks for a pixel to form a mono-color image; and transferring the image from the image forming sheet onto an image receptive medium, wherein each of different color inks contains water in a range of 40 to 95 weight % thereof, and wherein the image forming sheet comprises a support having an ink receiving layer containing a hydrophilic resin and a thermoplastic resin.

21 Claims, No Drawings

RE-TRANSFERABLE INK JET IMAGE FORMING METHOD AND AN IMAGE FORMING SHEET THEREOF

FIELD OF THE INVENTION

The present invention relates to a re-transferable ink jet image forming method and an image forming sheet thereof.

BACKGROUND OF THE INVENTION

In recent years, an ink jet recording system has been applied to various printing fields such as photography, various kinds of printing, and special printing such as marking and color filter, due to the fact that said system makes it possible to simply and inexpensively produce images. It has become possible to obtain the image quality equivalent to conventional silver salt photography, particularly employing a recording apparatus which ejects and controls minute ink droplets, ink which has been subjected to improvements in color reproduction range, durability and ejection adaptability, and special paper sheets which have been subjected to marked enhancement of ink absorbability, color forming properties of coloring materials, and surface gloss. Enhancement of image quality of the current ink jet recording system is achieved only when all the recording apparatus, ink, and special sheet are equally improved.

On the other hand, experiments have been conducted in which recording is carried out onto a transfer receptive medium which is different from said special paper sheets while employing an ink jet system. Specifically, said ink jet system includes an oil ink jet system in which an ink, comprised of rapid drying organic solvents as a main component, is employed, and a UV ink jet system, in which, after recording, exposure of UV radiation proceeds with crosslinking.

However, these methods have resulted in problems such as unpleasant odor due to high volatile ink, head clogging due to dried ink, bleeding due to different penetrating properties of ink, depending on substrates, and unstable drying (UV curing properties). Particularly, in recording onto a non-absorptive ink transfer receptive medium, as well as onto a transfer receptive medium which is not capable of controlling ink absorption, immediately after ink contact, it has been substantially difficult to obtain high quality images of high resolution.

Further, as a method to minimize bleeding immediately after ink contact, there is a phase change ink jet method in which a wax ink, which is solid at room temperature (e.g. 15 to 35° C.), is employed. Here, however, problems occur in which, since said ink is comprised of wax, it is difficult to obtain sufficient fixability of images.

In order to utilize the high quality image drawing properties which are inherent in said ink jet system, as well as to form an image onto a transfer receptive medium which is different from said special paper, a method is most effective in which an image is temporarily formed on a re-transferable ink jet image forming sheet, and subsequently, said resultant image is transferred onto an image receptive medium.

For example, Japanese Patent Publication Open to Public Inspection No. 6-23973 proposes a method in which a thermoplastic resin, such as a polyamide resin which melts at relatively low temperature, is applied onto a transparent plastic film, and ink jet recording is carried out onto the resultant film which is subsequently adhered onto a recording medium while heated. However, problems occur in which such a simple structure makes it difficult to obtain high resolution images which result in minimal bleeding.

Further, Japanese Patent Publication Open to Public Inspection No. 9-240196 proposes that by employing a transfer type image forming sheet material which is comprised of a support, a peeling coat layer, a top coat layer, an ink receiving layer, and an adhesive layer, adhesion properties to an adhesion receptive body, as well as weather resistance, are obtained. A method is proposed in which a thermoplastic resin or a delayed tack agent is applied to an adhesive layer so as to be porous and ink penetrable, and ink is absorbed in an ink receiving layer so that the surface remains adhesive. Alternately, as ink jet recording transfer medium which is transferred to OHP as disclosed in Japanese Patent Publication Open to Public Inspection No. 62-170383 and textiles for items such as T-shirts as disclosed in Japanese Patent Publication Open to Public Inspection No. 10-16382, a structure comprised of a base material (being a releasing layer), and a transfer layer comprised of fine thermoplastic resin particles, having a relatively large particle diameter and a polymer binding agent, is disclosed.

As described above, conventionally, in order to obtain absorbability and transferability of ink, a method is proposed in which the surface layer is allowed to be porous, and coarse thermoplastic resin particles are applied onto the surface.

However, these recording media are not capable of resulting in image drawing performance of the ink jet recording system in which image quality has been markedly enhanced in recent years, as described above.

Namely, methods in which the resin surface is allowed to be porous and coarse thermoplastic resin particles are employed as a main component, result in high ink absorbability of the recording layer. However, problems occur in which, due to high roughness of the surface, the image forming sheet tends to result in insufficient resolution as well as insufficient color forming properties. When heated and transferred, the porous layer or the fine thermoplastic particle layer is not sufficiently transparentized. When transparency is desired under said structure, ink absorbability is degraded. As a result, problems occur in which during ink jet recording, ink overflows and bleeding tends to occur due to said overflow. Further, depending on the kinds of images or recording modes, problems have occurred in which the image area results in neither sufficient transferability nor adhesion properties; images are distorted due to the distortion of the image area during transfer; and when images after transfer are stored for a long period of time, bleeding, as well as discoloration occurs.

Further, the present situation is that ink, as well as the recording method suitable for the re-transfer system, to obtain high image quality and high image durability has not yet been adequately developed.

SUMMARY OF THE INVENTION

An object of the present invention is to provide an ink jet image forming sheet which minimizes bleeding, exhibits high resolution as well as high color forming properties, and minimizes image distortion on a support which is commonly difficult to use for direct recording, yet results in high quality images which are equivalent to those obtained by employing a special image receptive paper sheet, and an image forming method in which images formed by employing said image forming sheet exhibit high durability.

The aforesaid object of the present invention was achieved employing items 1. through 21., as described below.

1. An image forming method, comprising the steps of:

jetting at least one of a plurality of different color inks for each pixel onto an image forming sheet by a plurality of ink-jet heads to form an image on the image forming sheet, the jetting step including a step of regulating a total amount of the plurality of different color inks for each pixel to form a mixed color image to be at most 250% of a predetermined maximum amount of one of the plurality of different color inks for a pixel to form a mono-color image; and transferring the image from the image forming sheet onto an image receptive medium by superimposing the image forming sheet on the image receptive medium and by applying pressure and heat on the image forming sheet and the image receptive medium superimposed, wherein each of the plurality of different color inks contains water in a range of 40 to 95 weight % thereof, and wherein the image forming sheet comprises a support having thereon an ink receiving layer containing a hydrophilic resin and a thermoplastic resin.

2. The image forming method of item 1, wherein each of the plurality of different color inks contains alkali metal ions in a range of 100 to 3000 weight ppm thereof, and wherein each of the plurality of different color inks further contains metal ions having at least two valences in an amount of at most 100 weight ppm thereof.

3. The image forming method of item 1, wherein each of the plurality of different color inks contains at least one of hydrophilic solvents selected from the group consisting of ethylene glycol, diethylene glycol, glycerin, propylene glycol, triethylene glycol, and triethylene glycol monobutyl ether in an amount of 1 to 30 weight % thereof.

4. The image forming method of item 1, wherein each of the plurality of different color inks has a viscosity of from 2.5 to 8.0 mpa·s and a surface tension of from 0.025 to 0.05 N/m.

5. The image forming method of item 1, wherein the plurality of different color inks comprises a yellow ink, a magenta ink, a cyan ink, a black ink, a light magenta ink and a light cyan ink.

6. The image forming method of item 1, wherein the plurality of different color inks comprises a yellow ink, a magenta ink, a cyan ink, a black ink, an orange ink and a green ink.

7. The image forming method of item 1, wherein each of the plurality of different color inks comprises a pigment.

8. The image forming method of item 7, wherein the pigment has an average particle diameter of 100 to 150 nm.

9. The image forming method of item 7, wherein the thermoplastic resin is capable of forming a film at a temperature of 15 to 35° C.

10. The image forming method of item 1, wherein each of the ink-jet heads jets a dot having a diameter D of the color inks which satisfies the following relationship:

$$D<1.7\times P,$$

P being a diameter of the pixel.

11. The image forming method of item 10, wherein at least one of the ink-jet head jets a dot having a diameter D of the color inks which satisfies the following relationship:

$$D<1.27\times P,$$

P being a diameter of the pixel.

12. The image forming method of item 1, wherein the total amount of the plurality of different color inks for each pixel to form a mixed color image is regulated at most 200% of a predetermined maximum amount of one of the plurality of different color inks for a pixel to form a mono-color image.

13. An image forming sheet for use in an image forming method which comprises the steps of:

jetting at least one of a plurality of different color inks for each pixel onto an image forming sheet by a plurality of ink-jet heads to form an image on the image forming sheet, the jetting step including a step of regulating a total amount of the plurality of different color inks for each pixel to form a mixed color image to be at most 250% of a predetermined maximum amount of one of the plurality of different color inks for a pixel to form a mono-color image; and transferring the image from the image forming sheet onto an image receptive medium by superimposing the image forming sheet on the image receptive medium and by applying pressure and heat on the image forming sheet and the image receptive medium superimposed, wherein each of the plurality of different color inks contains water in a range of 40 to 95 weight % thereof, and wherein the image forming sheet comprises a support having thereon an ink receiving layer containing a hydrophilic resin and a thermoplastic resin.

14. The image forming sheet of item 13, wherein the ink receiving layer has a transmittance of at least 80% in the visible region.

15. The image forming sheet of item 13, wherein the ink receiving layer is capable of absorbing water in an amount of at least 10 $g/m^2$.

16. The image forming sheet of item 13, wherein each of the hydrophilic resin and the thermoplastic resin in the ink receiving layer is a latex or an emulsion having particles of an average diameter of 0.05 to 2.5 $\mu$m.

17. The image forming sheet of item 16, wherein the hydrophilic resin is polyurethane comprising a hydrophilic group therein.

18. The image forming sheet of item 13, wherein the image receiving layer comprises a latex of thermoplastic resin, and wherein the thermoplastic resin is selected from the group consisting of polyurethane, polyester, an acrylic copolymer, ethylene-vinyl acetate, and styrene butadiene rubber.

19. The image forming sheet of item 13, wherein the image receiving layer comprises non thermoplastic particles.

20. The image forming sheet of item 13, wherein the support is made of a resin selected from the group consisting of stretched polyethylene terephthalate, stretched polypropylene, stretched polystyrene and stretched nylon.

21. The image forming sheet of item 13, wherein the image receiving layer comprises a white pigment.

DETAILED DESCRIPTION OF THE INVENTION

The present invention will now be detailed.

The inventors of the present invention conducted various investigations to overcome the problems described above. As a result, by employing the ink jet image forming sheet described below, it became possible to provide an image forming method which minimizes bleeding, exhibits high resolution as well as high color forming properties, and minimizes image distortion, on a support which is commonly difficult to use for direct recording, and results in high quality images which are equivalent to those obtained by employing a special image receptive paper sheet, and further improves the adhesion properties, lightfastness, and fixability of the formed image. In said ink jet image forming sheet employed in an image forming method in which a water-based ink, which is comprised of water in an amount of 40 to 95 parts by weight of the total ink, is ejected onto an ink jet image forming sheet comprising a support having thereon an ink receiving layer, employing an ink jet recording system; an image is formed by adjusting the total ejected ink amount to less than or equal to 250 percent; and subsequently, said image is transferred onto an image receptive medium under heat and pressure, said ink jet image forming sheet is characterized in comprising a hydrophilic resin as well as a thermoplastic resin.

The present invention will now be further detailed.

The ink jet image forming sheet is described hereunder.

The ink jet image forming sheet of the present invention is a re-transferable ink jet image forming sheet, and comprises at least a support having thereon an ink receiving layer comprising hydrophilic resins as well as thermoplastic resins. The ink jet image forming sheet of the present invention is employed as an intermediate sheet to form a final image.

Employed as supports according to the present invention may be both transparent and opaque base materials. After transferring an image onto an image receptive medium, when the resultant image is seen from the side of the base material of said ink jet image forming sheet, it is preferable to use a transparent base material. In such a case, the transmittance of the ink receiving layer in the visible region is preferably at least 80 percent.

Preferably listed as raw materials of said transparent base materials are polyester, polyolefin, polyamide, polyester amide, polyether, polyimide, polyamidoimide, polystyrene, polycarbonate, poly-p-phenylenesulfide, polyether ester, polyvinyl chloride, polyacrylic acid ester, polymethacrylic acid ester, polyethylene, and nylon. In addition, it is possible to use copolymers and mixtures thereof, and further, crosslinked compounds thereof.

More preferably listed as materials for the support are; stretched polyethylene terephthalate, stretched polypropylene, stretched polystyrene and stretched nylon. These are preferably used because of high transparency, high size stability, high stiffness, low environmental damage, and low cost.

Preferred thickness of the support is in the range of 2 to 100 $\mu$m, and more preferably in the range of 6 to 50 $\mu$m in consideration of the high efficiency of heating during the step of transfer of the image to the image forming sheet.

When the transferred image is seen from the back of the image receptive medium, the support used for the medium may be a transparent support or may be colored in white in order to achieve an appropriate visibility of the image. Paper supports or the above-mentioned resins which are adjusted to a required whiteness can be used. The adjustment of whiteness is achieved in accordance with the lighting ambience for seeing the image.

In order to achieve fine tuning of stickiness between the ink receiving layer and the support of the image forming sheet and to obtain good coating characteristics, corona discharge treatment or adhesion accelerating treatment, which are widely known, can be used for the support.

The ink receiving layer of the present invention comprises at least a hydrophilic resin and a thermoplastic resin. The weight % of the hydrophilic resin to the thermoplastic resin is 95:5 to 30:70, and preferably 90:10 to 50:50. When the amount of the hydrophilic resin is less than 30 weight %, a sufficient amount of ink cannot be retained and as a result, problems such as bleeding or searing during image transfer would occur. When the amount of the thermoplastic resin is less than 5 weight %, it would occurs problems in the image receptive medium.

Employed as hydrophilic resins according to the present invention may be; hydroxyethyl cellulose, starch, carboxymethyl cellulose, slats of arginine, slats of hyaluronic acid, slats of poly glutamic acid, chitosan, polylysine, polyvinyl alcohol, polyvinyl pyrrolidone, polyacrylic amide, poly-N-alkyl acrylic amide, polyhydroxyethyl acrylate, polyvinyl methyl ether, slats of polyacrylic acid, slats of poly(isobutylene-maleic acid), slats of poly(2-acrylic amide-2-methylpropane-sulphonic acid), slats of poly (methacryloyloxypropane sulphonic acid), slats of polyvinyl sulphonic acid, poly(methacryloyloxyethyl quaternary ammonium chloride), N,N-dimethyl-N-(3-acrylic amide propyl)-N-(carboxymethyl)ammonium internal salts, polyethylene glycol, polydioxolane, polyethylene imine.

In addition to those above, listed as hydrophilic compounds (and at the same time, allowed to be water absorbent) are compounds which are modified to be sparingly soluble through modification of a water-soluble group by crosslinking said water-soluble compounds or by allowing said water-soluble compounds to react with other compounds, compounds prepared by substituting a hydrophilic group such as a sulfo group, a carboxyl group, a phosphonic group, an amino group, a hydroxyl group, and a methoxy group to polyester, copolymers of polyacrylic acid ester or polymethacrylic acid ester, and polyurethane, and compounds substituted with a cationic polar group such as a primary, secondary, and tertiary amine, or a quaternary ammonium salt group.

In order to render hydrophilic resins to be highly water absorbent, it is essential that the osmotic pressure difference between said resins and the ink which comes into contact with said resins is provided by increasing the ion concentration in the interior of said resins.

Since it is possible to improve the absorbability of water-based ink and to minimize bleeding during image formation, as well as image distortion during heat-transferring, as said hydrophilic resins, it is preferable to employ sparingly water-soluble compounds of which water absorbability is enhanced by arranging the resin interior to have ionic properties.

Of these, from the viewpoint of ink absorbability, ink fixability, transparency, and enhancement of layer strength, polyurethane having a sulfo group, a carboxyl group, a phosphono group, an amino group, a hydroxyl group, and a methoxy group, as described above, is preferably employed. Of these, polyurethane having a sulfo group, and a carboxyl group is most preferably employed.

Preferably employed as thermoplastic resins employed in said ink receiving layer are polyurethane dispersed into water, polyester, polyacrylic acid ester, polymethacrylic acid ester, polyvinyl butyral, polyethylene, polypropylene, ethylene-vinyl acetate, ethylene-acrylic acid ester, vinyl chloride-vinyl acetate, styrene-butadiene rubber, and nylon.

Of these, polyester, polyurethane, polyacrylic acid (ester), polymethacrylic acid (ester), ethylene-vinyl acetate, and styrene butadiene rubber(SER) are preferably employed due to the following reasons. It is possible to adjust the softening point, and the adhesion properties corresponding to the image receptive medium and to provide water dispersibility as well as hydrophilicity upon combining types of these copolymerizable monomers and adjusting the degree of polymerization. Polyacrylic acid (ester) and polymethacrylic acid (ester) are most preferably employed due to their high transparency.

It is preferable that said hydrophilic resins as well as said thermoplastic resins are blended in a water-dispersed state such as a latex or an emulsion, which are then applied onto a support. It is assumed that by preparing a layer in such a manner that a coating composition comprised of said hydrophilic resins and thermoplastic resins is applied onto a support and subsequently dried so as to be not totally compatible with each other, it is possible to obtain thermal adhesion properties between the water absorbent and the image receptive body due to the presence of components of said hydrophilic resins as well as said thermoplastic resins. Further, since it is possible to further enhance ink absorbability as well as transferability by densely arranging said hydrophilic resins as well as said thermoplastic resins on the surface through decreasing those dispersed average particle diameter from 0.05 to 2.50 $\mu$m, and to decrease the resultant surface roughness, problems with bleeding do not occur, even though images with high resolution are printed. Further, it is possible to make said ink receiving layer markedly transparent.

In a so-called void type receptive layer comprised of minute porous particles as a main component, which is employed as a common receptive layer for ink jet printing, it is difficult to simultaneously attain excellence in the transparency, the re-transferability, and the ink absorbability which have been described in the present invention. Further, heretofore, an embodiment has been proposed in that in the presence of relatively large thermoplastic resinous particles, coating as well as drying is carried out at a temperature less than or equal to the minimum layer forming temperature. However, problems occur in which productivity is lowered and the resultant receptive layer is not perfectly transparentized.

However, by employing the structure described in the present invention, it is possible to carry out coating and drying at a temperature more than or equal to the minimum layer forming temperature of said hydrophilic resins as well as said thermoplastic resins. As a result, it is possible to enhance productivity as well as to prepare a receptive layer having markedly high transparency.

Additives, known in the art, can be incorporated in said ink receiving layer. For instance, if desired, incorporated may be UV absorbers to enhance image retention properties, penetrating agents as well as water retaining agents to enhance ink absorbability, cationic polymer electrolytes to enhance fixability of water-based dyes, surface active agents as well as antifoaming agents to achieve excellent coating, and non-thermoplastic particles to minimize blocking. Employed as non-thermoplastic particles may be inorganic particles such as alumina, silica, clay, diatomaceous earth, calcium carbonate, calcium sulfate, barium sulfate, aluminum silicate, synthetic zeolite, zinc oxide, lithopone, and satin white, as well as organic particles having a high Tg or a crosslinking structure. The diameter of said particles is preferably from 0.1 to 10.0 $\mu$m.

The proportion of these additives is preferably in the range of 1 to 20 percent by weight with respect to the total dry weight of said ink receiving layer, and is more preferably in the range of 5 to 10 percent by weight. However, when transparency is desired, it is preferable to adjust the added amount so that transmittance of visible light is at least 80 percent.

It is possible to suitably adjust the thickness of said ink receiving layer depending on the kinds of image receptive media. However, said thickness is preferably from 5 to 50 $\mu$m, and is more preferably from 10 to 40 $\mu$m.

Further, it is preferable to adjust the water absorption value of said ink receiving layer from 10 to 50 g/m$^2$ by adjusting the thickness of said ink receiving layer.

Herein, said water absorption value of said ink receiving layer can be obtained by immersing said ink receiving layer in pure water for one minute and determining the weight increase after scraping off surface water.

In addition to said ink receiving layer, an ink jet image forming sheet may be provided with other functional layers such as an adhesion receptive layer, a cushioning layer, an antistatic layer, an antireflection layer, a gloss adjusting layer, and a colored layer such as a white layer or a metallic layer. When, after transferring an image onto an image receptive medium, an ink receiving layer is transferred upon peeling of the support, in addition, provided may be a peeling layer and a protective layer so as to cover the surface of said ink receiving layer after transferring.

The image forming method of the present invention will now be described.

The image forming method of the present invention is the image forming method in which a water-based ink, which is comprised of water in an amount of 40 to 95 parts by weight of the total ink, is ejected onto an ink jet image forming sheet, described in the present invention, which comprises a support having thereon an ink receiving layer, employing an ink jet recording system; an image is formed by adjusting the maximum ejected ink amount to less than or equal to 250 percent; and subsequently, said image is transferred onto an image receptive medium under heat and pressure.

First, the ink according to the present invention will be described.

The ink, which is employed in the image forming method of the present invention, is a water-based ink which comprises coloring materials, water, and hydrophilic solvents. The compositions of solvents, employed in said water-based ink, markedly affects the quality of any formed images.

From the viewpoint of maintaining appropriate ink absorbability as well as to minimize image bleeding and smearing, the water proportion of the water-based ink, employed in the ink jet image forming sheet of the present invention, is preferably from 40 to 95 parts by weight of the total ink, and is more preferably from 60 to 95 parts by weight.

Cases, in which the proportion of water in said ink is less than 40 parts by weight, are not preferred due to the following reasons. When multicolor ink is repeatedly ejected onto the same position, said ink is not quickly absorbed due to the fact that said ink is not efficiently absorbed into the ink receiving layer comprised of hydrophilic resins. As a result, image bleeding occurs due to ink overflow; image smearing occurs during heat-transferring to the image receptive medium; and adhesion strength is markedly lowered.

In order to assure re-transferability to the image receptive medium as well as transparency of the ink receiving layer, the ink receiving layer according to the present invention is not to be comprised of a void type receptive layer but of hydrophilic resins employed as an ink absorbing material. As a result, said phenomena occur due to the low ink absorption rate compared to the common void type receptive layer which employs alumina and silica as an ink absorbing material.

Listed as hydrophilic solvents are, for example, alcohols (for example, methanol, ethanol, propanol, isopropanol, butanol, isobutanol, secondary butanol, tertiary butanol, pentanol, hexanol, cyclohexanol, and benzyl alcohol), polyhydric alcohols (for example, ethylene glycol, diethylene glycol, triethylene glycol, polyethylene glycol, polypropylene glycol, dipropylene glycol, polypropylene glycol, butylene glycol, hexanediol, pentanediol, glycerin, hexanetriol, and thiodiglycol), polyhydric alcohol ethers (for example, ethylene glycol monomethyl ether, ethylene glycol monomethyl ether, ethylene glycol monobutyl ether, diethylene glycol monomethyl ether, diethylene glycol monoethyl ether, diethylene glycol monobutyl ether, propylene glycol monomethyl ether, propylene glycol monobutyl ether, ethylene glycol monomethyl ether, triethylene glycol monomethyl ether, triethylene monoethyl ether, triethylene glycol monobutyl ether, ethylene glycol monophenyl ether, and propylene glycol monophenyl ether), amines (for example, ethanolamine, diethanolamine, triethanolamine, N-methylethanolamine, N-ethyldiethanolamine, morpholine, N-ethylmorpholine, ethylenediamine, diethylenediamne, triethylenetetraamine, tetraethylenepentaamine, polyethyleneimine, pentamethyldiethylenetriamine, and tetramethylpropylenediamine), amides (for example, formamide, N,N-dimethylformamide, and N,N-dimethylacetamide), heterocycles (for example, 2-pyrrolidone, N-methyl-2-pyrrrolidone, cyclohexylpyrrolidone, 2-oxazolidone, and 1,3-dimethyl-2-imidazolidonone), sulfones (for example, sulfolane), urea, acetonitrile, and acetone.

From the viewpoint of maintaining the ink absorbability of the ink receiving layer, effectively minimizing printing head clogging due to dried ink, and enhancing image retention properties (bleeding during long storage and lightfastness), any one of ethylene glycol, diethylene glycol, glycerin, propylene glycol, triethylene glycol, triethylene glycol monoethyl ether, or triethylene glycol monobutyl ether is preferably employed in an amount of 1 to 30 parts by weight of the total ink.

Employed as coloring materials used in the present invention may be coloring materials which can be dissolved or dispersed in water. Employed as said coloring materials may be conventional pigments, water-soluble dyes, and dispersion dyes, known in the art, however, in the image forming method of the present invention, hydrophilic solvents are to remain in the ink receiving layer. As a result, from the viewpoint of enhancing lightfastness as well as of minimizing bleeding during rather long storage, it is preferable to use pigments as well as dispersion dyes. Listed as examples are azo pigments such as azo lakes, insoluble azo pigments, condensed azo pigments, and chelate azo pigments; polycyclic pigments such as phthalocyanine pigments, perylene and perylene pigments; anthraquinone pigments, quinacridone pigments, dioxazine pigments, thioindigo pigments, isoindolinone pigments, and quinophtharony pigments; dye lakes such as basic dye type lake and acidic dye type lake; organic pigments such as nitro pigments, nitroso pigments, aniline black, daylight fluorescent pigments; and inorganic pigments such as carbon black.

Preferably employed as said dispersion dyes may be, for example, Disperse Yellow 3, 4, 42, 71, 79, 114, 180, 199, and 227; Disperse Orange 29, 32, and 73; Disperse Red 11, 58, 73, 180, 184, and 283; Disperse Violet 1, 26, and 4; and Disperse Blue 73, 102, 167, and 184.

In order to disperse pigments, it is possible to employ a ball mill, a sand mill, an attriter, a roll mill, an agitator, a Henschel mixer, a colloid mill, an ultrasonic homogenizer, a pearl mill, a wet type jet mill, or a paint shaker. Further, during dispersion of pigments, it is possible to add dispersing agents. Listed as dispersing agents are anion based and nonion based surface active agents or polymer dispersing agents.

Specifically listed are, for example, surface active agents such as higher fatty acid salts, alkylsulfates, alkylestersulfates, alkylsulfonates, sulfosuccinates, naphthalenesulfonates, alkylphosphates, polyoxyalkylenealkyletherphosphates, polyoxyalkylene alkyl phenyl ether, polyoxyethylene polyoxypropylene glycol, glycerin ester sorbitan ester, polyoxyethylene fatty acid amide, and amineoxide; block copolymers and random copolymers comprised of at least two types of monomers selected from styrene, styrene derivatives, vinylnaphthalene derivatives, acrylic acid, acrylic acid derivatives, maleic acid, maleic acid derivatives, itaconic acid, itaconic acid derivatives, fumaric acid, and fumaric acid derivatives, and salts thereof. Further, the alkali-soluble polymers of the present invention may be employed as said dispersing agents.

It is preferable to incorporate into ink, thermoplastic resins, which can form a layer at room temperature. Said thermoplastic resins are capable of not only aiding the adhesion to the image receptive medium but also improving image retention properties. Said thermoplastic resins are preferably added in the sate of a common latex. Listed as such latex polymers are, for example, styrene-butadiene copolymers, styrene, acrylonitrile-butadiene copolymers, acrylic acid ester copolymers, polyurethane, silicone-acrylic acid ester copolymers, and acryl modified fluororesins. Of these, acrylic acid ester copolymers, polyurethane, and silicone-acryl copolymers are preferred.

If desired, surface active agents may be incorporated in the water-based ink according to the present invention. Listed as surface active agents, which are preferably employed in the water-based ink for ink jet printing of the present invention, are, for example, anionic surface active agents such as dialkylsulfosuccinates, alkylnaphthalenesulfonates, and fatty acid salts; nonionic surface active agents such as polyoxyethylene alkyl ethers, polyoxyethylene alkyl allyl ethers, acetylene glycols, and polyoxyethylene-polyoxypropylene block polymers; and cationic surface active agents such as alkylamine salts and quaternary ammonium salts. Of these, anionic surface active agents, as well as nonionic surface active agents are preferred. If desired, in addition to these, antiseptics, mildewcides, and viscosity modifiers may be incorporated in the ink of the present invention.

In order to improve the ink absorbability of hydrophilic resins, it is preferable to maximize the ion strength difference in hydrophilic resins. To achieve this, the ion strength in the ink composition should be minimized. Due to that, it is particularly preferable that the total alkali metal ion concentration in the water-based ink is from 100 to 3,000 ppm and the total concentration of divalent and higher valent metal ions is less than or equal to 100 ppm.

The alkali metal ion concentration in ink can be quantitatively determined employing an ion meter, and methods such as ICP emission spectrochemical analysis. Alkali metal ions are introduced into a water-based pigment ink in the form of impurities incorporated in water, pigments, latex, and other raw materials which are employed to prepare said water-based pigment ink. The desired alkali metal ion concentration can be attained by adding inorganic salts and inorganic salt groups, having an alkali metal ion, directly to said water-base pigment ink, or adding to said water-based pigment ink in the form of counter ions of the hydrophilic group of emulsifiers, dispersing agents, alkali-soluble resins, latex polymers, and anionic surface agents.

Listed as inorganic salts and inorganic salt groups having an alkali metal ion, which are employed to adjust the alkali metal ion concentration, are, for example, sodium chloride, potassium chloride, sodium nitrate, potassium nitrate, sodium sulfate, disodium monohydrogenphosphate, sodium monohydrogenphophate, lithium chloride, sodium thiocyanate, potassium thiocyanate, sodium acetate, sodium hydroxide, potassium hydroxide, and lithium hydroxide.

Listed as methods to adjust the alkali metal ion concentration of the water-based ink, according to the present invention, in the range of 100 to 3,000 ppm, are a method in which an ink, which comprises alkali metal ions in an excessive amount, is previously prepared and subsequently, the alkali metal ion concentration is adjusted to the desired value by removing the excessive alkali metal ions, and also a method in which an ink, which has an alkali metal ion concentration less than the desired one is temporality prepared, and subsequently, the alkali metal ion concentration is adjusted by adding the aforesaid alkali metal containing compounds. Among these, the latter is preferred due to a simpler operation.

Further, in the present invention, it is preferable that the added amount of polyvalent metal ions are adjusted so as to be less than or equal to 1,000 ppm.

Listed as polyvalent metal ions are, for example, calcium ions, magnesium ions, aluminum ions, zinc ions, copper ions, nickel ions, silicon ions, and barium ions. The concentration of various kinds of polyvalent metal ions can be quantitatively determined employing an ion meter and ICP emission spectrochemical analysis.

When a colorant is a pigment containing polyvalent metal ions with a concentration of more than 100 ppm by weight, the stability of the pigment is deteriorated and, as a consequence, the image quality is lowered due to the aggregation of the pigment and the sticking ability of the pigment to the image receptive medium is decreased. Particularly, when a latex or a polymer dispersing agent is added to an ink containing a pigment, it is preferable to control the concentration of polyvalent metal ions in the ink.

When the water-based ink according to the present invention is employed, in order to obtain stable nozzle ejecting properties, the viscosity and the surface tension of said ink, which are liquid physical properties of said ink, are preferably in the range described below.

As the liquid physical properties of the water-based ink according to the present invention, the viscosity of said ink is preferably adjusted to be in the range of 2.5 to 8.0 mPa·s, and is more preferably adjusted to be in the range of 2.5 to 4.0 mPa·s so that said ink is quickly absorbed into the ink receiving layer.

Further, the surface tension of said water-based ink is preferably adjusted to be in the range of 0.025 to 0.05 N/m, and is more preferably adjusted to be in the range of 0.030 to 0.045 N/M.

The color image formation, employing the image forming method of the present invention, will now be described.

In the case of color image formation, employing the image forming method of the present invention, when a plurality of color inks is ejected, the total amount of ejected ink increases, whereby the amount of water, as well as hydrophilic solvents contained in the resultant image, increases. In the ink jet image forming sheet as well as the image forming method of the present invention, the adhesion properties onto the image receptive media as well as the degradation of image retention properties depend on the residual amount of water and hydrophilic solvents. As a result, it is particularly preferable to optimize the ink amount.

Said optimal value is obtained as follows. The maximum density (being the density in which value L*, expressed by CIE-L*a*b*(1976) color space, is minimized) of the each color of yellow, magenta, cyan, black, and specified colors is assigned to be ink amount 100 percent, while the minimum density (being the density when value L* becomes maximum) is assigned to be 0 percent. Then, the value obtained by performing linear conversion with respect to value L* is designated as the ink amount of each of the color inks. Total ejected ink amount (being the total ink amount) is preferably less than or equal to 250 percent, and is more preferably less than or equal to 200 percent. However, the lower limit of the ejected ink amount, which makes an image visible, is one percent.

In order to limit the total ejected ink amount, it is effective to increase the concentration of coloring materials of the ink and the maximum density of each color. Further, it is preferable that any gray component is replaced with black ink, employing a UCR and GCR method.

In order to improve highlight graininess, it is commonly known that a light shade of the same color, such as light magenta and light cyan, can be used. However, in said light shades of colored inks, the proportion of water, as well as hydrophilic solvents, to coloring materials increases. Consequently, in the present invention, when the proportion of the light shade increases, adhesion properties to the image receptive media, as well as image retention properties, are degraded. On account of that, in order to minimize the use of light shade ink, it is preferable to decrease the use proportion of light shade in middle tones as well as to limit the number of colors to two colors, consisting of light magenta and light cyan.

When specified colors are employed to increase a color reproduction range, 8 colors may be employed which consist of orange, green, yellow, magenta, cyan, black, and in addition, light magenta and light cyan. However, from the viewpoint of the limitation of the ink amount, it is preferable to employ only 6 colors, exempting light magenta and light cyan.

In the image forming method of the present invention, in order to maximize the adhesion strength and to minimize image smearing during heat-transferring, as well as to allow ink droplets to uniformly hit the surface, it is preferable to control the dot diameter. It is preferable to choose the droplet diameter D (in $\mu$m) which satisfies the relationship described below, so that more uniform images as well as adhesion properties can be obtained:

$$D<1.7\times P$$

wherein P (in $\mu$m) is the pixel size. Further, it is more effective to employ at least two dots of different sizes. In such a case, it was discovered that it was more effective to adjust the smaller or the smallest dot diameter so as to satisfy the relationship of $D<1.27\times P$.

The pixel size is a larger side length of one rectangular dot which forms a substantially minimum sized image unit on the image receptive medium. A substantially minimum sized image unit indicates a unit which can be distinguished as a dot.

When an image is finally transferred onto an image receptive medium, a preferred heating and pressing method is as follows. An ink jet image forming sheet and said receptive medium are placed onto heated rollers, or plates in which one side is comprised of an elastic body. Further, the heating temperature is preferably from 50 to 140° C., and is more preferably from 60 to 120° C.

In the present invention, employed as methods to provide solvents may be ink jet recording systems, known in the art. Listed as specific examples are on-demand type systems such as electrical-mechanical conversion systems (for example, a single cavity type, a double cavity type, a vendor type, a piston type, a shared mode type, and a shared wall type), electrical-thermal conversion systems (for example, a thermal ink jet type, and a bubble ink jet type), electrostatic attraction systems (for example, an electric field control type and a slit jet type), and discharge systems (for example, a spark jet type).

EXAMPLES

The present invention will now be described with reference to examples. However, the present invention is not limited to these examples.

Example 1

<<Preparation of an Ink Jet Image Forming Sheet>>

The ink receiving layer coating composition, described below, was applied onto a 25 $\mu$m thick polyethylene terephthalate(PET) film which had been subjected to an adhesion receptive treatment so as to obtain a dried coated weight of 20 g/m$^2$ and subsequently, dried at 100° C. for 10 minutes, whereby an ink jet image forming sheet was prepared.

| <<Preparation of Ink Jet Image Forming Sheet>> (Ink Receiving Layer Coating Composition 1) | |
|---|---|
| Hydrophilic resin: Urethane latex (Patelacol IJ-70, having solids of 14.4% and a particle diameter of 0.1 $\mu$m, manufactured by Dainippon Ink Kagaku Kogyo Inc.) | 26.04 weight parts |
| Thermoplastic resin: styrene-acryl latex (Yodosol GX-1, having solids of 50%, a particle diameter of 100 nm, and a Tg of 80° C., manufactured by Nippon NSC Co.) | 7.5 weight parts |
| Pure water | 16.4 weight parts |

The transmission density in the visible region of Ink Jet Image Forming Sheet 1, prepared as above, was measured employing a densitometer (Macbeth TD904, black density). The density of the film was 0.03 (95.3 percent in terms of transmittance), and the density of the ink receiving layer was 0.02 (95.5 percent in terms of transmittance), resulting in high transparency. When the sample was immersed in pure water for one minute, the amount of water absorbed was 25 g/m$^2$.

| <<Preparation of Ink Jet Image Forming Sheet 2>> (Ink Receiving Layer Coating Composition 2) | |
|---|---|
| Hydrophilic resin: Urethane latex (Patelacol IJ-70, having solids of 14.4% and a particle diameter of 0.1 $\mu$m, manufactured by Dainippon Ink Kagaku Kogyo Inc.) | 26.04 weight parts |
| Thermoplastic resin: acryl resin (dispersion of fine BMA-MMA copolymer particles, having a resin component of 50%, an average particle diameter of 0.08 $\mu$m, and a Tg of 58° C.) | 5.17 weight parts |
| Pure water | 18.79 weight parts |

The transmittance of the ink receiving layer of Ink Jet Image Forming Sheet 2, prepared as above, was approximately 100 percent, resulting in markedly high transparency. When the sample was immersed in pure water for one minute, the amount of absorbed water was 35 g/m$^2$.

| <<Preparation of Ink Jet Image Forming Sheet 3>> (Ink Receiving Layer Coating Composition 3) | |
|---|---|
| Hydrophilic resin: Urethane latex (Patelacol IJ-70, having solids of 14.4% and a particle diameter of 0.1 $\mu$m, manufactured by Dainippon Ink Kagaku Kogyo Inc.) | 25.35 weight parts |
| Thermoplastic resin: acryl resin (dispersion of fine BMA-MMA copolymer particles, having a resin component of 24.4%, an average particle diameter of 0.08 $\mu$m, and a Tg of 58° C.) | 5.17 weight parts |
| Non-thermoplastic particles: gas phase method non-crystalline silica (Aerosil A380S having a particle diameter of 5 nm, non-porous particles, manufactured by Nippon Aerosil Co.) | 0.1 weight part |
| Pure water | 18.79 weight parts |

The transmittance of the ink receiving layer of the Ink Jet Image Forming Sheet 3, prepared as above, was 92 percent. Even though the transparency was degraded somewhat compared to Ink Jet Image Forming Sheet 2, the water absorption value increased to 40 g/m$^2$.

| <<Preparation of Ink Jet Image Forming Sheet 4>> (Ink Receiving Layer Coating Composition 4) | |
|---|---|
| Hydrophilic resin: Urethane latex (Patelacol IJ-70, having solids of 14.4% and a particle diameter of 0.1 $\mu$m, manufactured by Dainippon Ink Kagaku Kogyo Inc.) | 24.31 weight parts |
| Thermoplastic resin: ionomer resin (Chemipearl S111, having solids of 40%, an average particle diameter of 0.1 $\mu$m, and an | 3.75 weight parts |

-continued

| <<Preparation of Ink Jet Image Forming Sheet 4>> (Ink Receiving Layer Coating Composition 4) | |
|---|---|
| MFT of 65° C,, manufactured by Mitsui Kagaku Inc.) | |
| Pure water | 21.94 weight parts |

The transmittance of the ink receiving layer of Ink Jet Image Forming Sheet 4, prepared as above, was 90 percent, and the water absorption value was 30 g/m$^2$.

<<Preparation of Ink Jet Image Forming Sheet 5>>

A white layer (having a yellow density of 0.3, which was determined employing a Macbeth densitometer) was applied onto the aforesaid PET film, and subsequently, the aforesaid Ink receiving layer Coating Composition 3 was applied. The resultant two-layer coating comprising the white ink receiving layer was designated as Ink Jet Image Forming Sheet 5.

The transmittance of the ink receiving layer of Ink Jet Image Forming Sheet 5, prepared as above, was 50 percent and, the water absorption value was 35 g/m$^2$.

<<Preparation of Comparative Ink Jet Image Forming Sheet 6>>

The ink receiving layer coating composition, described below, was applied onto the aforesaid film so as to obtain a dried coated weight of 20 g/m$^2$, and subsequently was dried at 65° C., whereby Ink Jet Image Forming Sheet 6 was prepared.

| (Preparation of Ink Receiving Layer Coating Composition) | |
|---|---|
| Fine nylon particles (Orgasol 3501, 10 μm), manufactured by Nippon Rirusan Co.) | 80 weight parts |
| Thermal reactive type urethane resin (Elastron MF-25, having 25% solids, manufactured by Daiichi Kogyo Seiyaku Co.) | 400 weight parts |
| Organic tin compound (Catalyst 64, manufactured by Daiichi Kogyo Seiyaku Co.) | 40 weight parts |
| Fine particle cellulose (Abicel PH-102, having a particle diameter of 40 μm, manufactured by Asahi Kasei Co.) | 20 weight parts |
| Polyallylamine hydrochloride (PAA-HCL-10L, having 40% solids manufactured by Nitto Boseki Co.) | 23 weight parts |
| Benzalkonium chloride (G 50 having 50% solids, manufactured by Sanyo Kasei Co.) | 12 weight parts |

The transmittance of the ink receiving layer of Ink Jet Image Forming Sheet 6, prepared as above, was less than 10 percent, and the water absorption value was 25 g/m$^2$.

<<Preparation of Pigment Dispersions>>

A yellow pigment dispersion, a magenta pigment dispersion, and a cyan pigment dispersion were prepared as described below.

| (Preparation of a Yellow Pigment Dispersion) | |
|---|---|
| C.I. Pigment Yellow 74 | 95 g |
| Demol C (manufactured by Kao Corp.) | 65 g |

-continued

| (Preparation of a Yellow Pigment Dispersion) | |
|---|---|
| Ethylene glycol | 100 g |
| Deionized water | 120 g |

The aforesaid materials were blended and dispersed employing a sand grinder filled with 0.5 mm zirconia beads in an amount of 50 percent in terms of a volume ratio, whereby a yellow pigment dispersion was prepared. The average diameter of the obtained pigment dispersion was 122 nm. Incidentally, said particle diameter was determined employing a Zeta Sizer 1000, manufactured by Malvern Instruments Inc.

| (Preparation of a Magenta Pigment Dispersion) | |
|---|---|
| C.I. Pigment Red 12 | 105 g |
| Johncryl 61 (acryl-styrene based resin, manufactured by Johnson Co.) | 60 g |
| Glycerin | 100 g |
| Deionized water | 130 g |

The aforesaid materials were blended and dispersed employing a sand grinder filled with 0.5 mm zirconia beads in an amount of 50 percent in terms of volume ratio, whereby a magenta pigment dispersion was prepared. The average diameter of the obtained pigment dispersion was 85 nm.

| (Preparation of a Cyan Pigment Dispersion) | |
|---|---|
| C.I. Pigment Blue 15:3 | 100 g |
| Demol C | 68 g |
| Ethylene glycol | 100 g |
| Deionized water | 125 g |

The aforesaid materials were blended and dispersed employing a sand grinder filled with 0.5 mm zirconia beads in an amount of 50 percent in terms of volume ratio, whereby a cyan pigment dispersion was prepared. The average diameter of the obtained pigment dispersion was 105 nm.

<<Preparation of Water-Based Inks>>

Water-based inks, having the compositions described below, were prepared employing the aforesaid pigment dispersions.

| (Yellow Ink) | |
|---|---|
| Yellow Pigment Dispersion | 110 g |
| Nipol SX1706 (48% solids, manufactured by Nippon Zeon Co., Ltd.) | 62.5 g |
| Ethylene glycol | 200 g |
| Triethylene glycol monobutyl ether | 150 g |
| Orufin 1010 (manufactured by Nissin Kagaku Co., Ltd.) | 4 g |
| Proxel GXL (manufactured by Zeneca Co.) | 2 g |
| Sodium chloride | 1.5 g |
| Potassium hydroxide | 1.4 g |

The total weight of these compounds was adjusted to 1,000 g by adding deionized water. After stirring well, the resulting mixture was passed twice through a Millipore filter machine, having a pore diameter of 1 μm, whereby yellow ink was prepared.

| (Magenta Ink) | |
|---|---|
| Magenta Pigment Dispersion | 140 g |
| Nipol SX1105 (solids 45%, manufactured by Nippon Zeon Co., Ltd.) | 56 g |
| Ethylene glycol | 150 g |
| Diethylene glycol monoethyl ether | 120 g |
| Pelex TO-P (manufactured by Kao Corp.) | 4 g |
| Proxel GXL | 2 g |
| Sodium hydroxide | 0.1 g |
| Potassium nitrate | 1.8 g |

The total weight of the aforesaid compounds was adjusted to 1,000 g by adding deionized water. After stirring well, the resulting mixture was passed twice through a Millipore filter machine, having a pore diameter of 1 μm, whereby magenta ink was prepared. Light magenta ink was also prepared in the same manner as above, except that said magenta pigment dispersion was employed in an amount of 1 to 4.

| (Preparation of Cyan Ink) | |
|---|---|
| Cyan Pigment Dispersion | 110 g |
| Takerack W605 (solids 30%, manufactured by Takeda Yakuhin Ltd.) | 267 g |
| Ethylene glycol | 100 g |
| Diethylene glycol | 140 g |
| Emulgen 913 | 4 g |
| Proxel GXL | 2 g |
| Sodium chloride | 1.3 g |
| Potassium chloride | 0.3 g |

The total weight of the aforesaid materials was adjusted to 1,000 g by adding deionized water. After stirring well, the resulting mixture was passed twice through a millipore filter machine, having a pore diameter of 1 μm, whereby cyan ink was prepared. Light cyan ink was also prepared in the same manner as above, except that said cyan pigment dispersion was employed in an amount of 1 to 4.

| (Preparation of Black Ink) | |
|---|---|
| Hostfine Black (having an average particle diameter of 50 nm, manufactured by Clariant Co., Ltd.) | 167 g |
| Latex (Superflex 110, manufactured by Daiichi Kogyo Seiyaku Co., Ltd.) | 167 g |
| Ethylene glycol | 200 g |
| Glycerin | 80 g |
| Orufin 1010 (manufactured by Nissin Kagaku Co., Ltd.) | 4 g |
| Proxel GXL (manufactured by Zeneca Co.) | 2 g |

The total weight of the aforesaid materials was adjusted to 1,000 g by adding deionized water. The resulting mixture was passed twice through a Millipore filter machine, having a pore diameter of 1 μm, whereby black ink was prepared.

As described above, 6 colors of ink (yellow, magenta, light magenta, cyan, light cyan, and black) were prepared, which were designated as Ink Set 1.

<<Image Formation>>

Images were prepared employing the aforesaid yellow (Y), magenta (M), light magenta, cyan (C), light cyan, and black (K) inks, while using an on-demand type ink jet printer having a maximum recording density of 720×730 dpi (at a pixel size of 35.3 μm, and dpi refers to the number of dots per 2.54 cm), which was equipped with a piezoelectric type head, having a nozzle hole diameter of 22 μm, a driving frequency of 40 kHz, the number of nozzles for each color being 128, and a nozzle density between the same colors of 90 dpi.

The graininess of magenta and of cyan was improved by including some proportion of each light color in the lower density portion.

Each of primary colors, Y, M, and C, secondary colors red (R), green (R), and blue (B), and tertiary colors of three color (YMC) and four color (YMCK), was printed stepwise, and color reproduction as well as image retention properties was evaluated.

In addition, bleeding was evaluated by printing black text onto a solid red color image. Further, in order to evaluate resolving power, a portrait was printed. Incidentally, the ink amount was limited and the UCR treatment was carried out so that the total amount of ejected ink was 250 percent.

Images were recorded on Ink jet Image Forming Sheets 1 through 5, employing the aforesaid Ink Set 1. It was found thereby that each of the ejected dots was circular and had a diameter of 52 μm. On the other hand, on comparative Ink jet Image Forming Sheet 6, the dots were not circular and were irregularly shaped due to bleeding. The maximum dot diameter was 70 μm.

Subsequently, each of the image recording surfaces of Ink Jet Image Forming Sheets 1 through 4, as well as Comparative Ink jet Image Forming Sheet 6, was faced with a 100 μm thick white PET as an image receptive medium, and was subjected to heat-transfer at 120° C., employing a laminator, whereby Samples 1 through 4 and 6 were prepared. On the other hand, Ink Jet Image Forming Sheet 5 was subjected to image transfer onto a 100 μm thick transparent PET in the same manner as above, and the image evaluation, described below, was carried out from the support side of the image receptive medium.

<<Evaluation of Ink Overflow, Bleeding, Resolving Power, Transparency, Image Smearing and Distortion during Transfer, Adhesion Properties, Color Forming Properties, and Image Fixability during Long Storage>>

(Ink Overflow)

One minute after image formation, ink drying on 4 color solid image portion, resulting in a maximum ink ejecred amount, was visually evaluated based on the ranking described below.

A: ink was sufficiently absorbed

B: ink was mostly dried (but commercially viable)

C: ink was not dried and not sufficiently absorbed.

(Bleeding)

The periphery of text characters was visually evaluated based on the ranking described below.

A: no bleeding was noticed and characters were clear

B: slight bleeding was noticed (but commercially viable)

C: bleeding was obvious.

(Resolving Power)

The reproduction of hair of the portrait subject was visually evaluated based on the ranking described below.

A: a clear image

B: clarity was slightly degraded (but commercially viable)

C: overall clarity of the entire image was lacking.

(Transparency)

The overall quality of the image surface was visually evaluated based on the ranking described below.

A: transparency was noticed without any haziness

B: slight whiteness was noticed (but commercially available)

C: a white and hazy image was obvious.

(Image Smearing and Distortion during Transfer)

The distortion of the boundary line between the image and the image receptive portion was visually evaluated based on the rank described below.

A: no distortion of boundary lines between the image and the image receptive portion was noticed B: slight distortion was noticed (but commercially viable)

C: distortion was obvious.

(Adhesion Properties)

The transfer image of the 4-color solid image portion, having a maximum ink amount, was subjected to a checkered pattern cutting until the support surface, employing a cutter, and was then adhered with adhesive tape (R). Subsequently, said adhesive tape was peeled off and the resulting peeled state was visually evaluated based on the ranking described below.

A: no peeling was noticed

B: several positions were peeled off (but commercially available)

C: almost all portions were peeled off.

(Color Forming Properties)

The maximum reflection density of magenta was determined. Said density was determined employing Spectrolino (a calorimeter, Blackbacking, ANSI-T, manufactured by Gretag Co.).

The obtained density value was evaluated based on the ranking described below.

A: density≧1.8

B: 1.8>density≧1.5 (but commercially available)

C: 1.5>density (Lightfastness)

An accelerated test was carried out employing a xenon fade meter. The samples were subjected to colorimetry and discoloration properties were determined. Measurement values were evaluated based on the ranking described below.

A: at least 90 percent of the image remained, resulting in almost no discoloration B: 50 to 90 percent of the image remained (but commercially viable)

C: less than 50 percent of the image remained.

(Image Fixability during Long Storage)

An accelerated test was carried out for one week at an ambience of 40° C. and 80 percent. The bleeding of text characters was evaluated based on the ranking described below.

A: no change was noticed

B: slight bleeding was noticed (but commercially viable)

C: bleeding was obvious.

The concentration of polyvalent ions in the ink used for making the samples 1 to 6 was not more than 1 ppm by weight.

Table 1 shows the obtained results.

TABLE 1

| Sample No. | Ink Jet Image Receptive Sheet | Ink Overflow | Bleeding | Resolving Power | Transparency | Image Smearing during Transfer | Adhesion Properties | Color Forming Properties | Lightfastness | Image Fixability during Long Storage | Remarks |
|---|---|---|---|---|---|---|---|---|---|---|---|
| 1 | 1 | B | A | A | A | A | A | A | A | A | Inv. |
| 2 | 2 | A | A | A | A | A | A | A | A | A | Inv. |
| 3 | 3 | A | A | A | B | A | B | A | A | A | Inv. |
| 4 | 4 | B | A | A | B | B | B | A | A | A | Inv. |
| 5 | 5 | A | A | A | A | A | A | A | A | A | Inv. |
| 6 | 6 | A | C | C | C | C | A | A | A | A | Comp. |

Inv.: Present Invention, Comp.: Comparative

As can clearly be seen from Table 1, the ink overflow, bleeding, resolving power, transparency, image smearing and distortion during transfer, adhesion properties, color forming properties, lightfastness, and image fixability during long storage of the samples of the present invention are superior to the Comparative ones.

Example 2

Ink Set 2 was prepared in the same manner as Ink Set 1, except that each ink was prepared by adding sodium chloride so that the total alkali metal ion concentration in each ink composition was 2,000 ppm.

Ink Set 3 was prepared in the same manner as Ink Set 1, except that each ink was prepared by adding sodium chloride so that the total alkali metal ion concentration in each ink composition was 4,000 ppm.

Further, the alkali metal ion concentration of Ink Set 1 was adjusted so as to be 300 ppm.

Herein, the alkali metal ion concentration was determined employing a commercially available ICP emission spectrochemical apparatus.

Employing Ink Jet Image Forming Sheet 2 in Example 1, comparison was made to Ink Set 1, regarding the evaluation items described in Table 2, and three kinds of samples were prepared. The evaluation was carried out in the same manner as for Example 1.

Table 2 shows the obtained results.

TABLE 2

| Sample No. | Ink Image Forming Sheet | Ink Set No. | Ink Over-flow | Bleed-ing | Image Smearing during Transfer | Adhesion Proper-ties | Color Forming Proper-ties | Alkali Metal Ion Concent-ration |
|---|---|---|---|---|---|---|---|---|
| 1 | 2 | 1 | A | A | A | A | A | 300 ppm |
| 2 | 2 | 2 | A | A | A | B | A | 2000 ppm |
| 3 | 2 | 3 | B | B | B | B | B | 4000 ppm |

As can clearly be seen from Table 2, by adjusting the alkali metal ion concentration of ink compositions in the range of 100 to 3,000 ppm, the image forming method employing the ink jet image forming sheet of the present invention results in further improvements in all characteristics such as the ink overflow, bleeding, image smearing and distortion during transfer, adhesion properties, and color forming properties.

Example 3

Without changing the resolution (at a pixel size of 35.3 μm), the ink jet printer employed in Example 1 was modified so as to print images employing single sized dots as well as two sized dots, being small and large, through forming two sizes of droplets by varying the head driving conditions.

Said large dots were adjusted to be 52 μm which was the same as Example 1, while said small dots were adjusted to be 40 μm. A maximum density portion was formed employing only 52 μm dots in the same manner as Example 1. On the other hand, for the formation of a middle tone, an error diffusion pattern was varied so that two sized dots, being small and large, were randomly arranged.

Subsequently, by employing Ink Jet Image Forming Sheet 4 and Ink Set 1 in Example 1, images were formed while varying the total ejected ink amount as described in Table 3. The obtained 4 kinds of samples were evaluated for image quality as described in Table 3.

However, color forming properties were evaluated as follows. While varying to a magenta color, the black density of 4-color portions was evaluated based on the ranking described below.

A: density≧2.1

B: 2.1>density≧1.8 (being commercially available)

C: 1.8>density

Further, the adhesion properties were evaluated at a more severe ambience of a relatively high temperature (50° C.) upon varying the room temperature.

Table 3 shows the obtained results.

TABLE 3

| Sample No. | Dot Size | Ink Amount (in %) | Ink Image Forming Sheet | Ink Set No. | Ink Over-flow | Image Smearing during Transfer | Adhesion Proper-ties | Color Forming Proper-ties |
|---|---|---|---|---|---|---|---|---|
| 1 | 1 kind* | 250 | 4 | 1 | B | B | B | A |
| 2 | 2 kinds* | 250 | 4 | 1 | B | A | A | A |
| 3 | 2 kinds* | 200 | 4 | 1 | A | A | A | A |
| 4 | 2 kinds* | 150 | 4 | 1 | A | A | A | B |

1 kind*: 52 μm dot
2 kinds*: 2 kinds of dots, 52 μm and 40 μm, were used.

As can clearly be seen from Table 3, when two sized dots, being small and large, were employed, specifically, the image smearing and distortion during transfer were minimized and the adhesion properties and the like were further improved.

The present invention is capable of providing an ink jet image forming sheet which minimizes bleeding, exhibits high resolution as well as high color forming properties, and minimizes image distortion, on a support which is commonly difficult to use for direct recording, and results in high quality images which are equivalent to those obtained by employing a special image receptive paper sheet, and an image forming method in which images, formed by employing said image forming sheet, exhibit high durability.

What is claimed is:

1. An image forming method, comprising the steps of:

jetting at least one of a plurality of different color inks for each pixel onto an image forming sheet by a plurality of ink-jet heads to form an image on the image forming sheet, the jetting step including a step of regulating a total amount of the plurality of different color inks for each pixel to form a mixed color image to be at most 250% of a predetermined maximum amount of one of the plurality of different color inks for a pixel to form a mono-color image; and transferring the image from the image forming sheet onto an image receptive medium by superimposing the image forming sheet on the image receptive medium and by applying pressure and heat on the image forming sheet and the image receptive medium superimposed, wherein each of the plurality of different color inks contains water in a range of 40 to 95 weight % thereof, and wherein the image forming sheet comprises a support having thereon an ink receiving layer containing a hydrophilic resin and a thermoplastic resin.

2. The image forming method of claim 1, wherein each of the plurality of different color inks contains alkali metal ions in a range of 100 to 3000 weight ppm thereof, and wherein each of the plurality of different color inks further contains metal ions having at least two valences in an amount of at most 100 weight ppm thereof.

3. The image forming method of claim 1, wherein each of the plurality of different color inks contains at least one of hydrophilic solvents selected from the group consisting of ethylene glycol, diethylene glycol, glycerin, propylene glycol, triethylene glycol, and triethylene glycol monobutyl ether in an amount of 1 to 30 weight% thereof.

4. The image forming method of claim 1, wherein each of the plurality of different color inks has a viscosity of from 2.5 to 8.0 mPa·s and a surface tension of from 0.025 to 0.05 N/m.

5. The image forming method of claim 1, wherein the plurality of different color inks comprises a yellow ink, a magenta ink, a cyan ink, a black ink, a light magenta ink and a light cyan ink.

6. The image forming method of claim 1, wherein the plurality of different color inks comprises a yellow ink, a magenta ink, a cyan ink, a black ink, an orange ink and a green ink.

7. The image forming method of claim 1, wherein each of the plurality of different color inks comprises a pigment.

8. The image forming method of claim 7, wherein the pigment has an average particle diameter of 100 to 150 nm.

9. The image forming method of claim 7, wherein the thermoplastic resin is capable of forming a film at a temperature of 15 to 25° C.

10. The image forming method of claim 1, wherein each of the ink-jet heads jets a dot having a diameter D of the color inks which satisfies the following relationship:

$$D<1.7\times P,$$

P being a diameter of the pixel.

11. The image forming method of claim 10, wherein at least one of the ink-jet head jets a dot having a diameter D of the color inks which satisfies the following relationship:

$$D<1.27\times P,$$

P being a diameter of the pixel.

12. The image forming method of claim 1, wherein the total amount of the plurality of different color inks for each pixel to form a mixed color image is regulated at most 200% of a predetermined maximum amount of one of the plurality of different color inks for a pixel to form a mono-color image.

13. An image forming sheet for use in an image forming method which comprises the steps of:

jetting at least one of a plurality of different color inks for each pixel onto an image forming sheet by a plurality of ink-jet heads to form an image on the image forming sheet, the jetting step including a step of regulating a total amount of the plurality of different color inks for each pixel to form a mixed color image to be at most 250% of a predetermined maximum amount of one of the plurality of different color inks for a pixel to form a mono-color image; and transferring the image from the image forming sheet onto an image receptive medium by superimposing the image forming sheet on the image receptive medium and by applying pressure and heat on the image forming sheet and the image receptive medium superimposed, wherein each of the plurality of different color inks contains water in a range of 40 to 95 weight % thereof, and wherein the image forming sheet comprises a support having thereon an ink receiving layer containing a hydrophilic resin and a thermoplastic resin.

14. The image forming sheet of claim 13, wherein the ink receiving layer has a transmittance of at least 80% in the visible region.

15. The image forming sheet of claim 13, wherein the ink receiving layer is capable of absorbing water in an amount of at least 10 $g/m^2$.

16. The image forming sheet of claim 13, wherein each of the hydrophilic resin and the thermoplastic resin in the ink receiving layer is a latex or an emulsion having particles of an average diameter of 0.05 to 2.5 $\mu$m.

17. The image forming sheet of claim 16, wherein the hydrophilic resin is polyurethane comprising a hydrophilic group therein.

18. The image forming sheet of claim 13, wherein the image receiving layer comprises a latex of thermoplastic resin, and wherein the thermoplastic resin is selected from the group consisting of polyurethane, polyester, an acrylic copolymer, ethylene-vinyl acetate, and styrene butadiene rubber.

19. The image forming sheet of claim 13, wherein the image receiving layer comprises non thermoplastic particles.

20. The image forming sheet of claim 13, wherein the support is made of a resin selected from the group consisting of stretched polyethylene terephthalate, stretched polypropylene, stretched polystyrene and stretched nylon.

21. The image forming sheet of claim 13, wherein the image receiving layer comprises a white pigment.

* * * * *